US005898442A

United States Patent [19]

Takebe

[11] Patent Number: 5,898,442

[45] **Date of Patent: *Apr. 27, 1999**

[54] DISPLAY CONTROL DEVICE

[75] Inventor: Makoto Takebe, Hiratsuka, Japan

[73] Assignee: Kabushiki Kaisha Komatsu Seisakusho, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/521,841

[22] Filed: Aug. 31, 1995

[30] Foreign Application Priority Data

Sep. 2, 1994 [JP] Japan ..... 6-210014

[51] Int. Cl.[6] ..... G09G 5/00

[52] U.S. Cl. ..... 345/507; 345/509; 345/516

[58] Field of Search ..... 345/2, 103, 185, 345/200, 203, 188, 507, 516, 508, 509, 515, 517; 348/523, 571, 572, 714, 716; 365/221, 230.1, 230.4, 230.5, 230.8, 230.9; 395/507, 509, 515, 517

[56] References Cited

U.S. PATENT DOCUMENTS

| | | | |
|---|---|---|---|
| 4,742,350 | 5/1988 | Ko et al. | 348/523 |
| 4,778,260 | 10/1988 | Okada et al. | 345/103 |
| 4,816,816 | 3/1989 | Usui | 345/103 |
| 5,309,168 | 5/1994 | Itoh et al. | 345/185 |
| 5,357,606 | 10/1994 | Adams | 345/509 |
| 5,387,923 | 2/1995 | Mattison et al. | 345/103 |
| 5,568,165 | 10/1996 | Kimura | 345/507 |
| 5,572,691 | 11/1996 | Koudmani | 345/516 |
| 5,724,063 | 3/1998 | Chee et al. | 345/103 |

*Primary Examiner*—Amare Mengistu
*Attorney, Agent, or Firm*—Welsh & Katz, Ltd.

[57] ABSTRACT

A display control device for displaying data stored in a video memory on a flat display such as an EL or liquid crystal display on the basis of display control signals output from a CRT control device, which comprises a memory means that allows data read and write operations to be executed simultaneously and that has a capacity to store at least one screen of display data for display on the flat display and display control means for alternately executing, in accordance with the display control signals, a first operation in which data corresponding to an upper half of the display screen are retrieved from the data stored in the video memory and sequentially output to an upper region of the display, data corresponding to the upper half of the display screen are sequentially stored in the memory means, and data corresponding to a lower half of the display screen stored in the memory means are sequentially output to a lower region of the display, and a second operation in which data corresponding to the lower half of the display screen are retrieved from the data stored in the video memory and sequentially output to the lower region of the display, data corresponding to the lower half of the display screen are sequentially stored in the memory means, and data corresponding to the upper half of the display screen stored in the memory means are sequentially output to the upper region of the display

3 Claims, 8 Drawing Sheets

| | M1 | M2 | - - - - | Mn-1 |
|---|---|---|---|---|
| READ RESET TIMING | n-1/n | n-2/n | - - - - | 1/n |
| READ START ADDRESS | 1/n | 2/n | - - - - | n-1/n |

DISPLAY CONTROL DEVICE

BACKGROUND OF THE INVENTION

1. Field of the Invention

This invention relates to a display control device capable of driving not only CRTs but also ELs, liquid crystal displays and other flat displays, using a CRT controller.

2. Description of the Related Art

When an EL, liquid crystal display, or other flat display is driven using a CRT controller, it is necessary to perform raster scanning at speeds twice those of CRT displays in order to prevent diminished screen brightness. Thus, when driving an EL or liquid crystal display using a CRT controller, single-scanning line signals are expanded into double-scanning line signals for output to the display. The LVIC design is one design for accomplishing this. This LVIC design involves retrieving display data equivalent to one screen from the data stored in a video memory and temporarily placing it into another memory, while simultaneously outputting double-scanning line signals from this latter memory to the display.

In the LVIC design, a single port RAM is used as the memory for storing display data for one screen. Data is read out for output to the display during times that display data is not being written into the RAM from the video memory.

Thus, since the conventional LVIC design requires reading out data for output to the display during times that display data is not being written into the single port RAM from the video memory, the timing of write operations to RAM and the timing of read out operations sometimes overlaps; in such cases, display data output is postponed When the bus occupation rate by write operations is high, the time available for output of data to the display is shortened, so the conventional LVIC design provides poor tracking with moving screens or when switching between screens, and experiences diminished brightness.

SUMMARY OF THE INVENTION

With the foregoing in view, an object of this invention is to provide a display control device that has good tracking with moving screens or when switching between screens, and that affords a bright image display with ELs, liquid crystal displays, and other flat displays driven using a CRT controller.

The present invention provides a display control device by which display data stored in a video memory is displayed on a flat display on the basis of display control signals output from a CRT control device, wherein the display control device comprises memory means that allows data read and write operations to be executed simultaneously and that has the capacity to store at least one screen of display data for display on the flat display, and display control means for alternately executing, in response to the display control signals, a first operation in which data corresponding to the upper half of the display screen are retrieved from the data stored in the video memory and sequentially output to the upper region of the display, the data corresponding to the upper half of the display screen are sequentially stored in the memory means, and data corresponding to the lower half of the display screen stored in the memory means are sequentially output to the lower region of the display, and a second operation in which data corresponding to the lower half of the display screen are retrieved from the data stored in the video memory and sequentially output to the lower region of the display, the data corresponding to the lower half of the display screen are sequentially stored in the memory means, and data corresponding to the upper half of the display screen stored in the memory means are sequentially output to the upper region of the display.

The invention is applied for a dual scan system in which a display is partitioned into two regions, an upper region and a lower region. Display data in a video memory is temporarily stored in memory means, such as a dual port RAM capable of allowing data read and write operations to be performed simultaneously and is output directly to the dual scan system display. Direct data from the video memory or data read out from the memory means are regularly transmitted in alternating fashion to the upper and lower regions of the display so that the scanning cycle of each pixel of the display is shortened.

The present invention also provides a display control device by which display data stored in a video memory is displayed on a flat display on the basis of display control signals output from a CRT control device, wherein the display screen of the flat display is partitioned into n partitions ($n \geqq 2$) in the vertical direction, and the display control device comprises (n−1) memory means that allow data read and write operations to be executed simultaneously, and that have a capacity to store at least one screen of display data for display on the flat display, read/write control means for performing sequential common input of the display data in the video memory to the (n−1) memory means and for performing sequential cyclic read operations on the stored data using, as an initial address, an address shifted to a degree equivalent to the address corresponding to data for (1/n) of the screen of the display from the (n−1) memory means, and nth data selection means for alternately selecting, in a specified order, data from the data read from the (n−1) memory means and stored data in the video memory and outputting the selected data to the partitioned regions of the display.

In the present invention, (n−1) memory means having a capacity to store at least one screen of display data for display on the display is provided so as to cope with n scans of a display partitioned into n screen partitions ($n \geqq 2$) in the vertical direction; data read from the (n−1) memory means and data retrieved from stored data in the video memory are alternately selected in a specified order, and the selected data are output to the partitioned regions of the display.

DESCRIPTION OF THE PREFERRED EMBODIMENTS

Embodiments of this invention will be described in detail below referring to the appended drawings.

Figure 2:
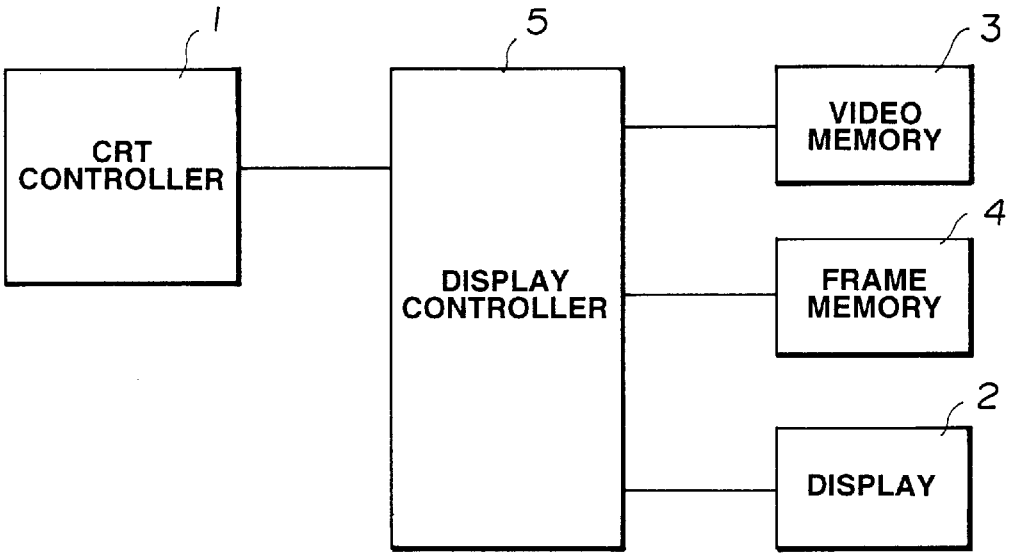
FIG. 2 is a block diagram depicting the overall structure of the embodiment of this invention.

FIG. 2 is a block diagram depicting schematically the overall structure of an embodiment of this invention A CRT controller 1 is an ordinary device for controlling display of CRT displays. This CRT controller 1 outputs display control signals such as a horizontal synchronizing signal, HS, a vertical synchronizing signal, VS, and a display blanking signal, BLANK. The horizontal synchronizing signal HS is a synchronizing signal output during each single horizontal scan; the vertical synchronizing signal VS is a synchronizing signal output during each scan of one screen. The BLANK signal is intended to blank display data at the vertical and horizontal edges of the screen, and serves the function of an output-enable signal for display data.

A CRT can of course be used as a display 2; here, however, we assume the use of an EL, liquid crystal display, or other flat display. Data for the display to be displayed on the display 2 is stored in a video memory 3 in the form of a single screen bit-map. In this case, a frame memory 4 is a dual port memory capable of allowing simultaneous write and read operations; like the video memory 3, it has the capacity to store display data for one screen to be displayed on the display 2.

On the basis of the horizontal synchronizing signal HS, vertical synchronizing signal VS, display blanking signal BLANK, and the like from the CRT controller 1 and using the frame memory 4, the display controller 5 converts display data stored in the video memory 3 into double-scanning line signals and performs the control functions required for display on the display 2.

Figure 1:
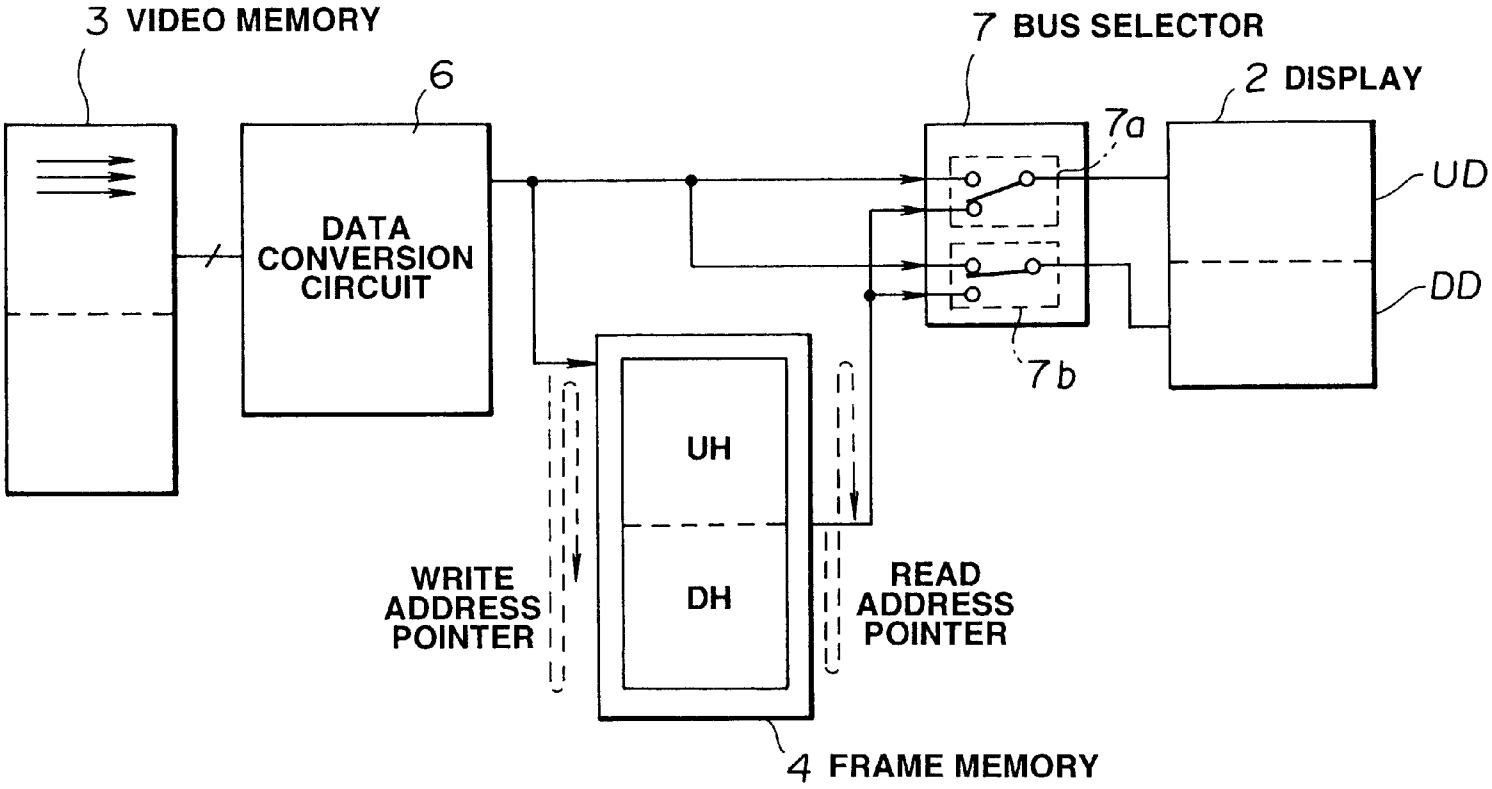
FIG. 1 is a block diagram depicting conceptually the principal structure of an embodiment of this invention.

FIG. 1 depicts conceptually a structure used in implementing a two-screen partition control system (dual scan system) in accordance with the present invention. The display 2 is partitioned into an upper screen, UD, and a lower screen, DD; these are scanned by separate scanning line signals.

In FIG. 1, display data stored in the video memory 3 is read out, for example, in 8-bit increments and is input to a data conversion circuit 6; in the data conversion circuit 6, it is converted, for example, into 4-bit data. The 4-bit data output by the data conversion circuit 6 are input sequentially in 4-bit increments to a bus selector 7 and the frame memory 4 in an order corresponding to the raster scan. The number of bits read out from the video memory 3 can be 4 bits or 16 bits.

Data input sequentially in 4-bit increments are stored at corresponding addresses in the frame memory 4. For the sake of simplicity, it is assumed that display data are stored in the frame memory 4 in relationships of position identical to those of the display 2. That is, like the display 2, the frame memory 4 is partitioned conceptually into two partitions, an upper screen region, UH, that stores data corresponding to the upper screen and a lower screen region, DH, that stores data corresponding to the lower screen. The upper screen region UH and the lower screen region DH in the frame memory 4 are not partitioned into two by means of ordinary address signals; rather, division into an upper screen region UH and a lower screen region DH is accomplished as a result of sequential incremental modification of the address pointers of the frame memory 4.

Read-out of data from the frame memory 4 starts at the lower screen region DH, which is located a half screen away from the data write operation.

Figure 3:
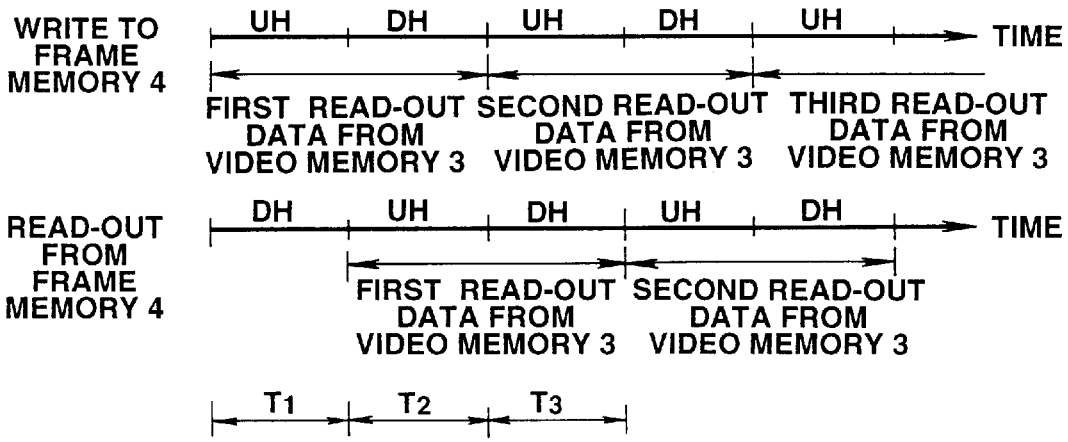
FIG. 3 is a time chart depicting data write and read operations of the frame memory 4.

Specifically, at the start of a data write operation to the frame memory 4, data corresponding to the upper screen are written sequentially to the upper screen region UH of the frame memory 4, while at the same time data are read out sequentially from the lower screen region DH of the frame memory 4 (period T1 in FIG. 3). Subsequently, when the sequential data write operation to the upper screen region UH and the data read-out operation from the lower screen region DH have been completed, data corresponding to the next lower screen are written sequentially to the lower screen region DH of the frame memory 4 and data are read out from the upper screen region UH of the frame memory 4 (period T2 in FIG. 3). Data read out during this data read-out operation are the data that were written during the previous write operation.

When the data write operation to the lower screen region DH and the data read-out operation from the upper screen region UH are subsequently completed, data corresponding to the next upper screen are written sequentially to the upper screen region UH of the frame memory 4 and data are read out from the lower screen region DH of the frame memory 4 (period T3 in FIG. 3).

The write and read-out operations described above are executed repeatedly in the frame memory 4.

The bus selector 7 selects either data coming directly from the video memory 3 (hereinafter termed "through data"), input from the data conversion circuit 6, or data read out from the frame memory 4 ("read data") for output to the display 2. In terms of this function, it is provided with a first switching circuit 7*a* for selecting either through data for the upper screen UD or read data read out from the upper screen region UH of the frame memory 4 and for outputting this data to the upper screen region UD of the display 2, and a second switching circuit 7*b* for selecting either through data for the lower screen DD or read data read out from the lower screen region DH of the frame memory 4 and for outputting this data to the lower screen region DD of the display 2.

Figure 4:
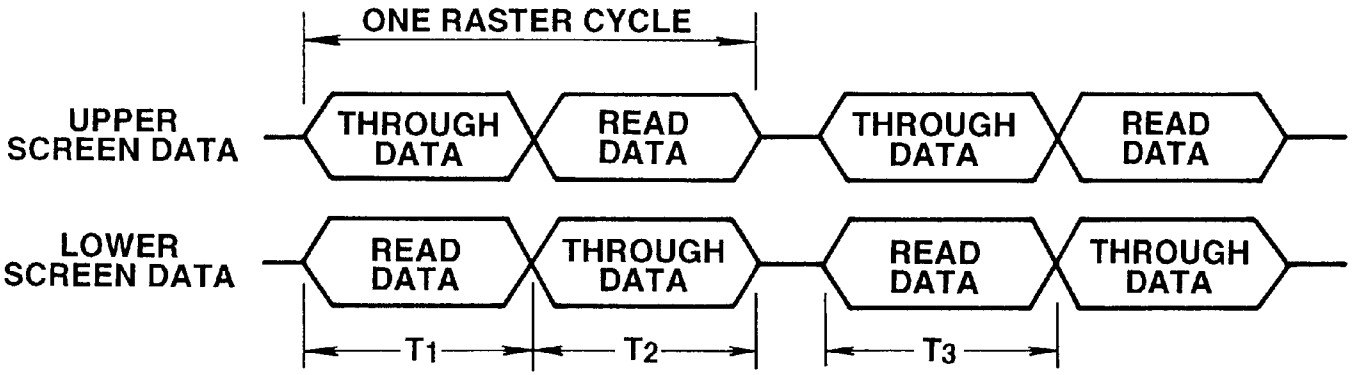
FIG. 4 is a time chart depicting a data switching operation by the bus selector.

The bus selector 7 executes bus switching control in the manner depicted in FIG. 4.

Specifically, during the period extending from the start of data read-out from the video memory 3 to the output from the video memory 3 of all data corresponding to the upper screen region UD, the first switching circuit 7*a* selects the through data and outputs them sequentially to the upper screen region UD of the display 2; the second switching circuit 7*b* selects the read data and outputs them sequentially to the lower screen region DD of the display 2 (period T1 in FIG. 4). As a result, upper screen data from the video memory 3 are output directly, as through data, to the upper screen UD of the display 2 and lower screen data for the previous cycle, stored in the lower screen region DH of the frame memory 4, are output to the lower screen region DD of the display 2. Upper screen data output from the video memory 3 are given to the bus selector 7 as through data and are written sequentially to the upper screen region UH of the frame memory 4.

Next, during the period in which data for the lower screen region DD coming from the video memory 3 are output, the first switching circuit 7*a* selects the read data and outputs them sequentially to the upper screen region UD of the display 2; the second switching circuit 7*b* selects the through data and outputs them sequentially to the lower screen region DD of the display 2 (period T2 in FIG. 4). As a result, lower screen data from the video memory 3 are output directly, as through data, to the lower screen DD of the display 2 and upper screen data, stored in the upper screen region UH of the frame memory 4, are output to the upper screen region UD of the display 2. During this operation as well, lower screen data output from the video memory 3 are given to the bus selector 7 as through data and are written sequentially to the lower screen region DH of the frame memory 4.

Next, during the period in which data for the upper screen region UD coming from the video memory 3 are again output, the first switching circuit 7*a* selects the through data and outputs them sequentially to the upper screen region UD of the display 2; the second switching circuit 7*b* selects the read data and outputs them sequentially to the lower screen region DD of the display 2 (period T3 in FIG. 4). As a result, upper screen data from the video memory 3 are output directly, as through data, to the upper screen UD of the display 2 and lower screen data stored in the lower screen region DH of the frame memory 4, are output to the lower screen region DD of the display 2. Upper screen data output from the video memory 3 are given to the bus selector 7 as through data and are written sequentially to the upper screen region UH of the frame memory 4.

The bus selector 7 executes this operation repeatedly.

Figure 5:
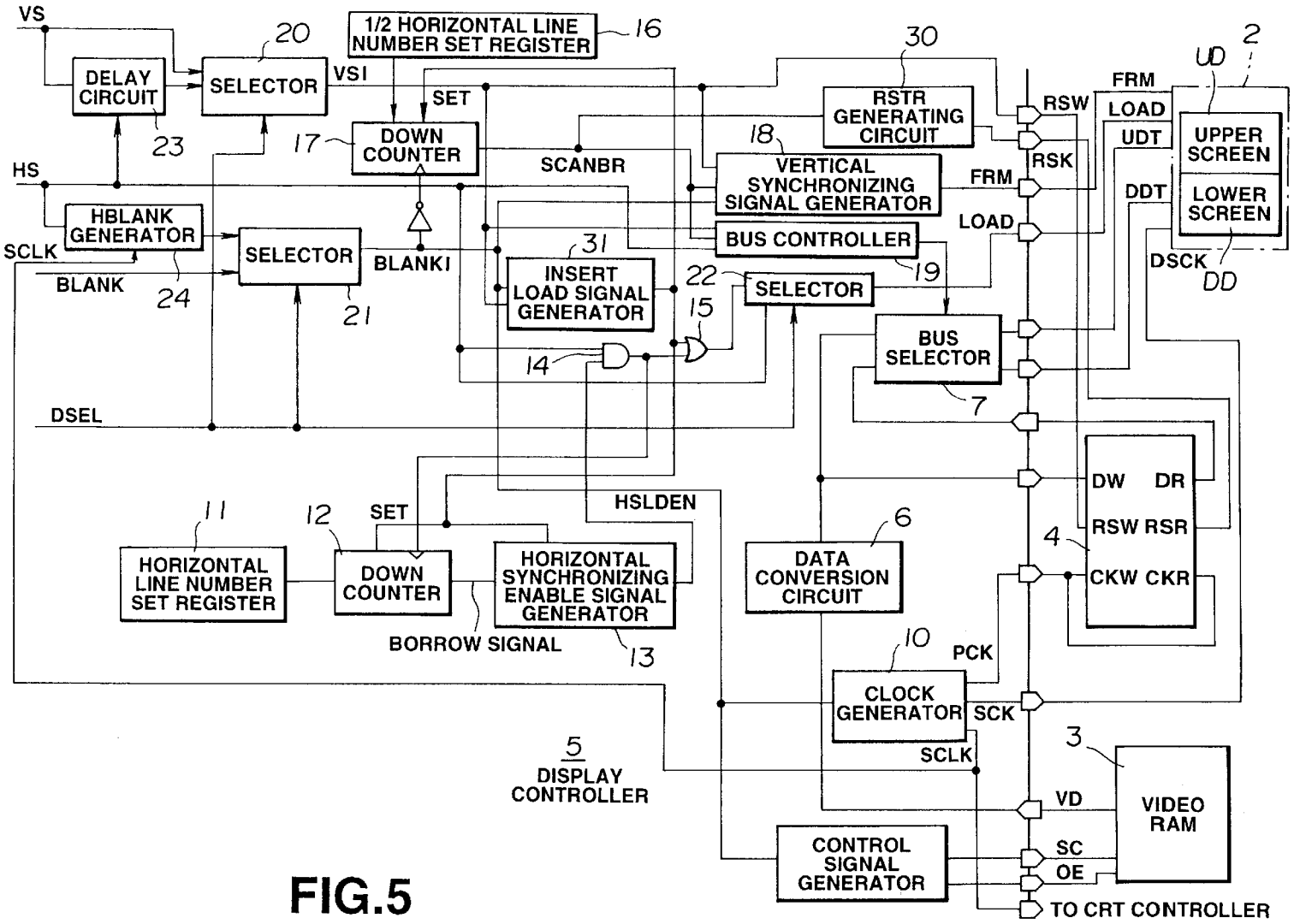
FIG. 5 is a detailed circuit diagram of the display controller 5.

FIG. 5 illustrates in detail the structure of the display controller 5 depicted in FIG. 2; it is designed so that an EL display and a liquid crystal display can be driven using the same circuit structure.

The characteristics of liquid crystal displays require that the horizontal synchronizing signal HS be transmitted at a constant cycle at all times (even during vertical blanking between screen scans), while EL displays allow transmission of the horizontal synchronizing signal HS to be halted between screen scans. This is a significant difference between the two.

Thus, the system permits switching of the display selection signal DSEL between H and L states in accordance with the type of display used, so that specified circuit sections can be switched between EL display driver and liquid crystal display driver modes.

Signals and terminals pertaining to the display 2, the frame memory 4, and the video memory 3 in FIG. 5 will now be described.

In the display 2, UDT indicates upper screen data input to the upper screen region UD, DDT indicates lower screen data input to the lower screen region DD, and DSCK indicates a raster scan clock signal. LOAD corresponds to the horizontal synchronizing signal HS, and FRM corresponds to the vertical synchronizing signal VS.

The frame memory 4 comprises dual port RAM; DW indicates a data terminal for writing, DR indicates a data terminal for reading, RSW indicates a write address reset terminal, RSR indicates a read address reset terminal, CKW indicates a write clock input terminal, and CKR indicates a read clock input terminal. In this dual port RAM 4, signals input to the address reset terminal RSW and RSR serve to reset the write address and the read address to the initial address of "0". further, an address pointer system is employed in which each time a clock signal is given to the write clock input terminal CKW, the write address is updated in increments of +1; similarly, each time a clock signal is given to the read clock input terminal CKR, the read address is updated in increments of +1.

The video memory 3 operates in such a way that stored video data, VD, synchronized with a BLANKI signal input from the display controller 5, are output sequentially (in 8-bit increments, for example) to the data conversion circuit 6. The data conversion circuit 6 converts the input 8-bit data into 4-bit data and outputs them sequentially to the bus selector 7 of the display controller 5.

Figure 6:
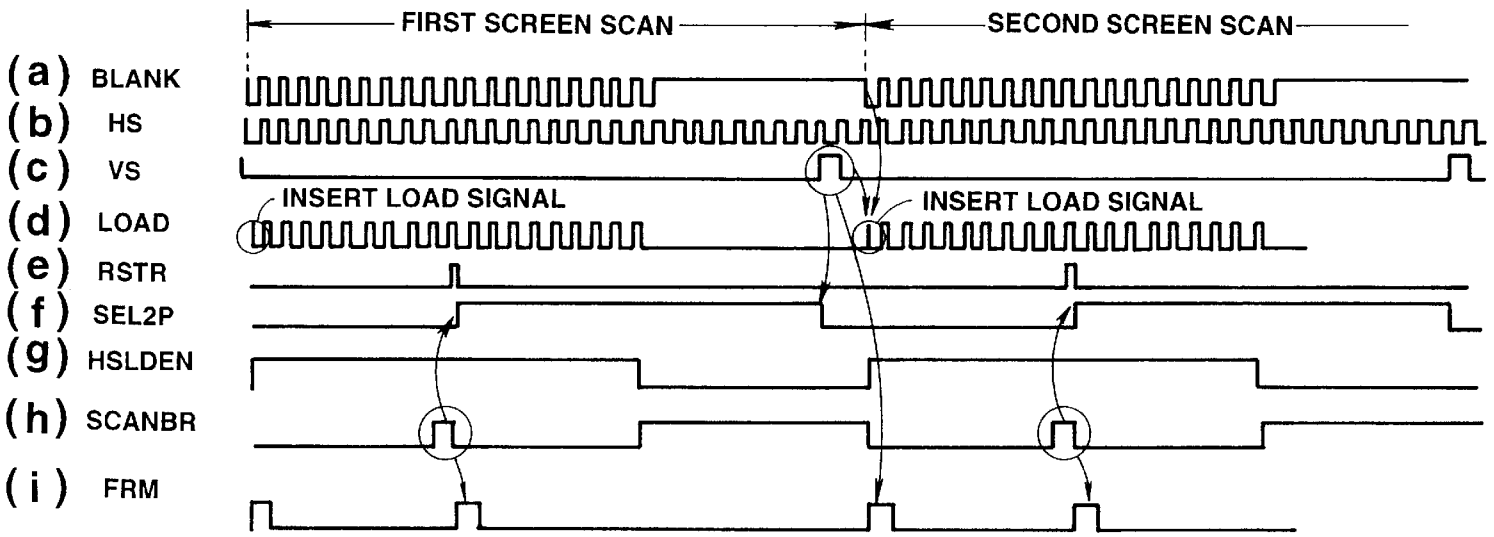
FIG. 6 is a time chart of the various types of signals in the detailed circuit diagram of FIG. 5 when an EL display is used.

As indicated by parts (*a*), (*b*) and (*c*) of FIG. 6, display blanking signal BLANK, horizontal synchronizing signal HS, and vertical synchronizing signal VS are input to the display controller 5 from the CRT controller 1 depicted in FIG. 2. FIG. 6 is a time chart depicting the case when the driven display is an EL display; for the sake of convenience, display blanking signal BLANK, which indicate significant data segments, is output so as to cover 20 lines per screen.

First, a clock generator 10 contained in the display controller 5 generates a pointer clock signal, PCK, of a specified period in intervals corresponding to the display period (BLANK=L). This signal is input to the write and read clock input terminals CKW and CKR of the dual port RAM 4. The read and write addresses in the dual port RAM 4 are increased in increments of 1 in synchronization with the pointer clock signal PCK. The clock generator 10 also generates a display sampling clock signal, SCK, which is output to the clock terminal DSCK of the display 2. The clock generator 10 also generates a clock signal, SCLK, which is output to the CRT controller 1 and to an HBLANK generator 24.

When an EL display is used as the display 2 with this display controller 5, the display selection signal DSEL assumes, for example, H state, whereby the selector 20 selects the direct vertical synchronizing signal VS which has not passed through the delay circuit 23, the selector 21 selects a screen blanking signal BLANK which has not passed through the HBLANK generator 24, and the selector 22 selects a signal from the gate 15.

When a liquid crystal display is used as the display 2, the display selection signal DSEL assumes, for example, L state, whereby the selector 20 selects the output of the delay circuit 23, the selector 21 selects the output of the HBLANK generator 24, and the selector 22 selects the direct horizontal synchronizing signal HS.

<In the Case of EL Display>

First, the structure of the EL display driver circuit in the display controller 5 will be described.

The vertical synchronizing signal, VSI, selected by the selector 20 (=VS, part (*c*) of FIG. 6) is input to the write address reset terminal RSW of the dual port RAM 4, whereby the dual port RAM 4 write address is reset each time data for one screen is written to the dual port RAM 4 in synchronization with the vertical synchronizing signal VSI (=VS).

In a ½ horizontal line number set register 16, a value corresponding to ½ the number of horizontal lines in the selected display 2 is set. A down counter 17 operates so that the value stored in the ½ horizontal line number storage register 16 is set when an insert LOAD signal has been output by an insert LOAD signal generator 31 (see part (*d*) of FIG. 6), or at each subsequent fall in the BLANKI signal when the borrow signal SCANBR (part (*h*) of FIG. 6) output by the counter itself has assumed H state; it performs a down count operation in which the set value is decreased by 1 each time a screen blanking signal BLANK is input, generates the borrow signal SCANBR when the count reaches 0 (part (*h*) of FIG. 6), and operates to output the signal SCANBR to a vertical synchronizing signal generator 18 and a bus controller 19.

As will be described below, an insert LOAD signal generator 31 generates a first-line horizontal scan timing signal (insert LOAD signal; part (*d*) of FIG. 6) on the basis of a vertical synchronizing signal VSI (=VS) and a BLANKI signal (=BLANK) output from the selector 21.

The borrow signal SCANBR is input to an RSTR generating circuit 30 and is converted into an RSTR signal of the type depicted in part (*e*) of FIG. 6. This is subsequently input to the read address reset terminal RSR of the dual port RAM 4. In this way, read addresses in the dual port RAM 4 are reset in synchronization with the RSTR signal each time writing of data for the upper half of the screen to the dual port RAM 4 is completed; as a result, the subsequent read operation starts at the upper screen region UH of the dual port RAM 4.

A vertical synchronization signal generator 18 outputs the vertical synchronization signal VSI (=VS), input from the selector 20, that is slightly delayed by the BLANKI signal (=BLANK) and the borrow signal SCANBR that is slightly delayed by the BLANKI signal (=BLANK) to produce a vertical synchronization signal FRM for the display 2, which is output to the display 2 (part (*i*) of FIG. 6). The FRM signal is generated twice during one screen scan, i e., at the start point of each screen scan and at completion of one-half of a screen scan, for each of the two vertical partitions of the display 2.

A bus controller 19 executes bus switching control of the bus selector 7; it outputs a bus switch signal SEL2P, to the bus selector 7 (part (*f*) of FIG. 6). When the bus switch signal SEL2P is in L state, output VD from the video RAM 3 is output as upper screen data, UDT, and data read out from the dual port RAM 4 is output as lower screen data, DDT; in the H state, data read out from the dual port RAM 4 is output as upper screen data UDT while output VD from the video RAM 3 is output as lower screen data DDT. In the bus controller 19, when the borrow signal SCANBR is detected, the signal SEL2P is placed in H state by the timing of the horizontal synchronization signal HS, and is subsequently made to fall to L state by the vertical synchronization signal VSI (=VS).

Next, the first-line horizontal scan timing signal (insert LOAD signal; part (*d*) of FIG. 6) is generated in the insert LOAD signal generator 31 on the basis of the vertical synchronizing signal VSI (=VS) and the BLANKI signal (=BLANK) input from the selector 21. Specifically, the insert LOAD signal is generated each time that the vertical synchronizing signal VS has been input and it is detected that the BLANKI signal has assumed L state.

In the horizontal line number storage register, a number corresponding to the number of horizontal lines in the used display 2 is set. The down counter 12 sets the value in the horizontal line number storage register 11 each time an insert LOAD signal is generated, and performs a down count operation in which the set value is decreased by 1 each time a horizontal synchronization signal HS is input; when the count reaches 0, a borrow signal is output to the horizontal synchronization enable signal generator 13. The horizontal synchronization enable signal generator 13 generates a horizontal synchronization enable signal HSLDEN that rises to H state when an insert load signal is input and that falls to L state when a borrow signal is input from the down counter 12 (part (*g*) of FIG. 6). The horizontal synchronization enable signal HSLDEN is used to enable the horizontal synchronization signal HS when the signal HSLDEN is in the H state. The horizontal synchronization enable signal HSLDEN is input to an AND circuit 14, where AND operations with horizontal synchronization signals HS are performed.

The logical sum of the output of the AND gate 14 and the insert LOAD signal is determined in the gate 15 and output, through the selector 22, to the display 2 in the form of a horizontal synchronization signal LOAD. Horizontal scanning is performed in the display 2 in synchronization with the input horizontal synchronization signal LOAD.

<In the Case of Liquid Crystal Display>

Figure 7:
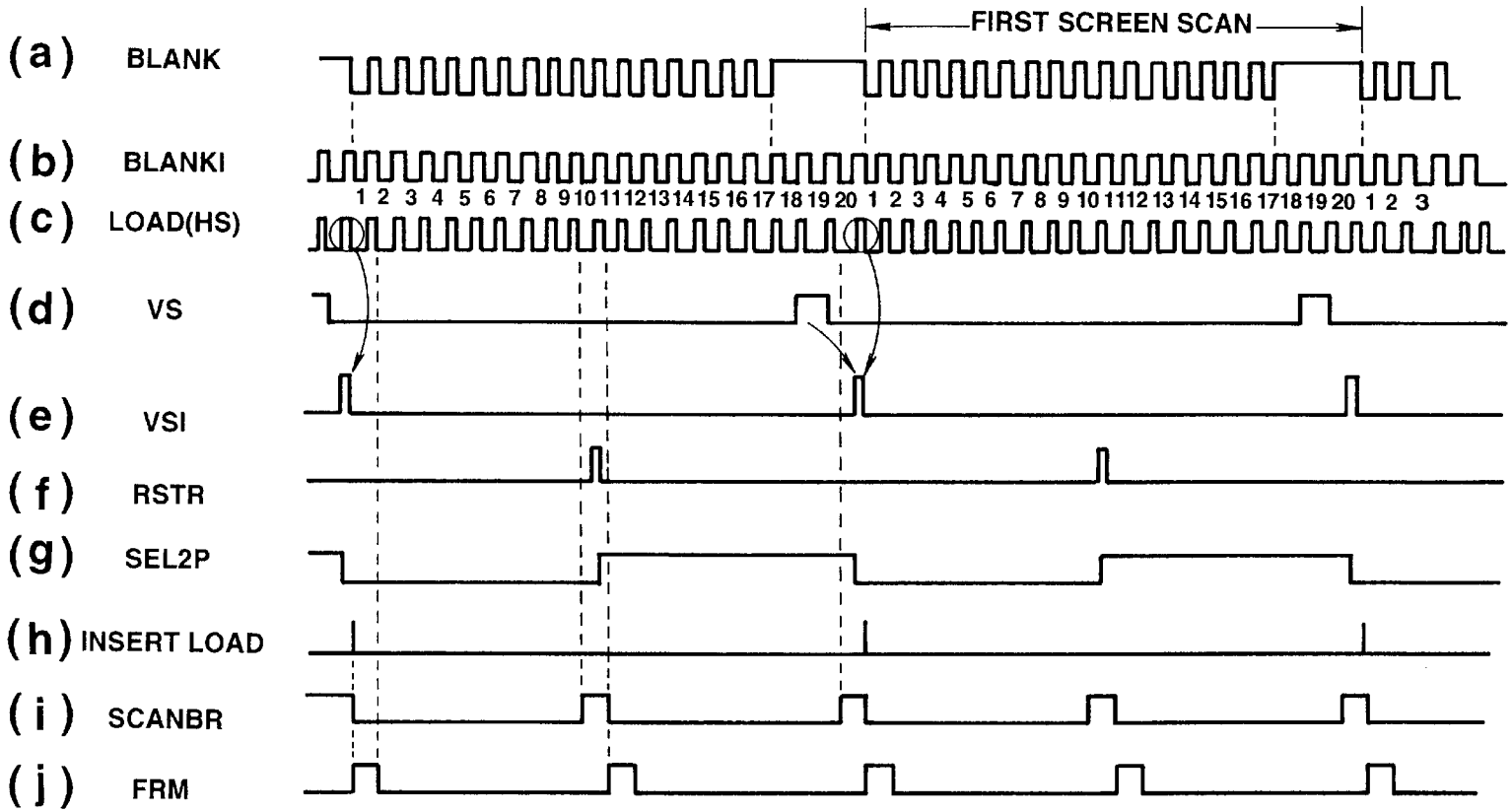
FIG. 7 is a time chart of the various types of signals in the detailed circuit diagram of FIG. 5 when a liquid crystal display is used.

Next, the structure of the liquid crystal display driver circuit in the display controller 5 will be described. FIG. 7 shows a time chart of the various type of signals when a liquid crystal is used as the display 2.

In a case where the CRT is controlled by the CRT controller 1, the horizontal and vertical display intervals are limited by the display blanking signal BLANK, the logical product of the vertical blanking signal VBLANK and the horizontal blanking signal HBLANK. With regard to the display screen in the vertical direction, display regions equivalent several lines at the top and bottom edges are blanked by the vertical blanking signal VBLANK, so there is a difference between the number of the screen blanking signal and the number of the horizontal synchronization signal HS output from the CRT control 1 during a single screen display period.

Assuming, for example, a 640×480 pixel liquid crystal display, a duty of 1/240 (the denominator indicates the number of horizontal synchronizations in an area equivalent to one-half screen) is required; when setting the number, KH, of CRT controller 1 horizontal synchronization signal HS and the number, KB, of display blanking signal BLANK, the two numbers (here, KH=480, KB=477) cannot be congruent for the reason noted above. Thus, when it is attempted to drive a liquid crystal display under such conditions, control of read-out from the video RAM 3 (synchronized with the BLANK signal) and control of data input to the display 2 (synchronized with the HS signal) cannot be synchronized.

In this embodiment, the two numbers are made congruent by producing the BLANKI signal for output to the video RAM 3 on the basis of horizontal synchronization signal HS rather than by using BLANK signal from the CRT controller 1.

This operation is performed by an HBLANK generating component 24. The HBLANK generator 24 is designed so that an HBLANK signal is output each time that a horizontal synchronization signal HS is input in synchronization with the horizontal synchronization signals HS. The starting point of the HBLANK signal is adjusted, on the basis of the horizontal back porch, using clock signal SCLK and horizontal synchronization signal HS (parts (*a*) and (*b*) of FIG. 7) In FIG. 7, KH=20 and KB=17.

The transmission timing of the vertical synchronization signal VS is delayed in the delay circuit 23 to compensate for the increased number of BLANK signal (3 in the case when KH=20 and KB=17) generated by the HBLANK generator 24 so that the vertical synchronization signal VSI comes just before the first line of data for one screen (parts (*d*) and (*e*) of FIG. 7).

When a liquid crystal display is used, the DESL signal prompts the selector 20 to select the output of the delay circuit 23, the selector 21 to select the output of the HBLANK generator 24, and the selector 22 to select the direct horizontal synchronizing signal HS. Other components of the circuit operate in the same way as with the EL display described above.

The structure of the circuit depicted in FIG. 5 and described above allows for control of display modes appropriate for both EL displays and liquid crystal displays using a general-purpose CRT controller 1.

In the foregoing embodiment, a dual scanning system involving partition of the display screen into two partitions was employed, but a screen partition system involving three or more partitions would also be possible.

Figures 8, 9:
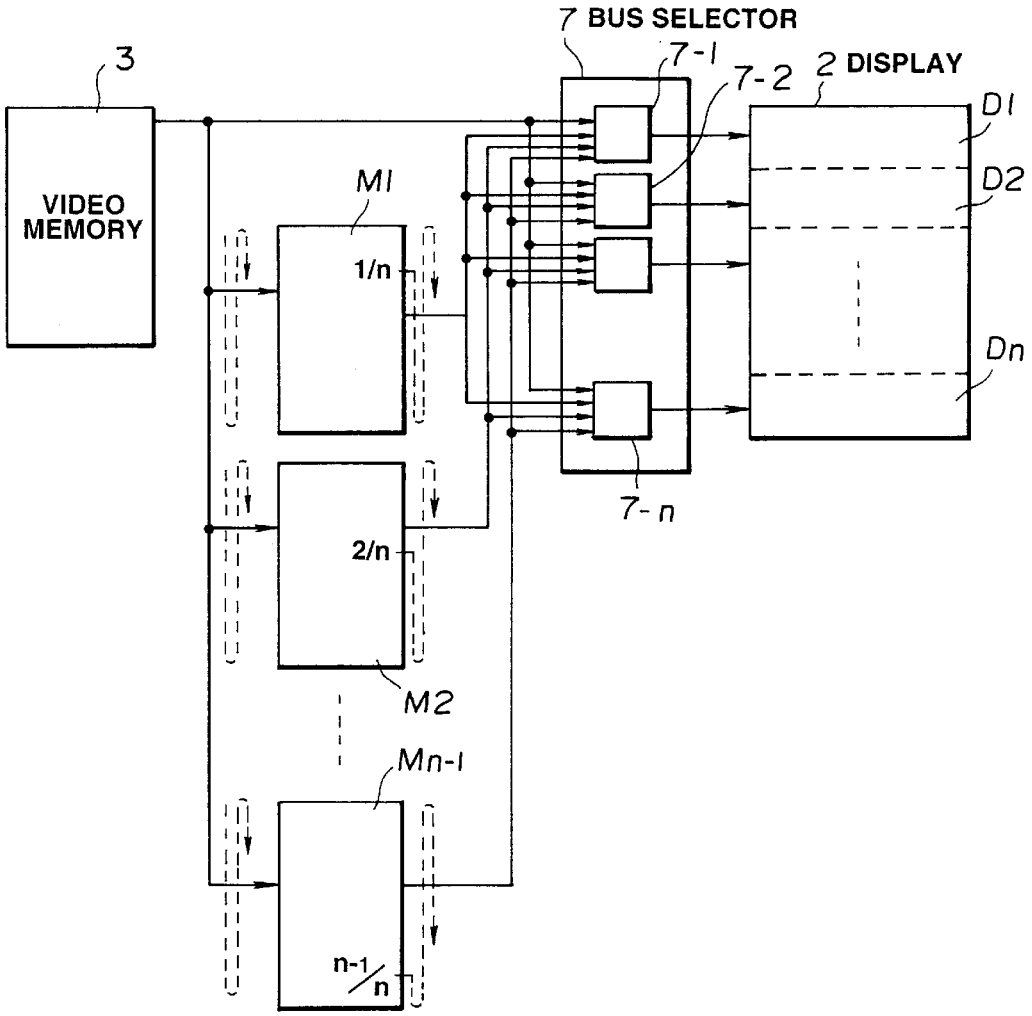
FIG. 8 is a block diagram depicting conceptually the principal structure of an embodiment of this invention when an n screen partition system is used.
FIG. 9 is a diagram depicting the dual port memory read-out commencement address and read-out reset timing in the embodiment of FIG. 8.

FIG. 8 depicts a structure that can be employed in an n scanning system in which the display is partitioned into n partitions. The display 2 is partitioned into screen partitions (beginning from the top) D1, D2, . . . , Dn, and these screen partitions D1, D2, . . . , Dn are coupled with separate data buses.

When the display 2 is partitioned into n partitions, (n−1) dual port memories, M1, M2, M3, . . . , Mn-1 are provided. Each of these memories, M1, M2, M3, . . . , Mn-1 has a data storage capacity equivalent to one screen on the display 2.

Data that is read out sequentially from the video memory 3 is input jointly to each of the (n−1) dual port memories, M1, M2, M3, . . . , Mn-1 and to the bus selector 7.

Data write operations to the dual port memories, M1, M2, M3, . . . , Mn-1 are executed by means of identical operations for each memory M1, M2, M3, . . . , Mn-1. Specifically, in each memory M1, M2, M3, . . . , Mn-1, write addresses, synchronized with the clock signals, are sequentially increased in increments of 1 from the initial addresses indicated by the write address pointers; when writing of data from the video memory 3 for one screen is completed, identical operations are repeated from the initial addresses.

Data read-out operations from the dual port memories M1, M2, M3, . . . , Mn-1 are executed using the read start addresses and reset timing depicted in FIG. 9. Specifically, with regard to the read start addresses, the address of memory M1 is 1/n, that of memory M2 is 2/n, and that of memory Mn-1 is n−1/n. The read start address of memory M1, 1/n, for example, indicates a converted value which assumes the end address of the memory area of data equivalent to one screen of the display to be 1. With regard to the timing of reset on the read side when read address pointers are reset and read addresses are initialized to initial addresses, the timing for memory M1 is n−1/n, that for memory M2 is n−2/n, and that for memory Mn-1 is 1/n. The read start addresses are not set in any special manner; when the read start timing is controlled in the manner described above, the values indicated in FIG. 9 are obtained as a result. Thus, the display screen produced by the first data read-out operation from video memory 3 is actually not displayed correctly, but-data produced by the second and subsequent data read-out operations from video memory 3 are displayed correctly The scanning cycle afforded under the aforementioned conditions is rapid and is not visible to the human eye, and thus produces no deleterious effects.

The bus selector 7 selects either direct data (hereinafter termed through data ) from the video memory 3 or data read from the dual port memories M1, M2, M3, Mn-1 (read data) and outputs them to each screen partition D1 through Dn of the display 2. Functionally, it comprises switching circuits 7-1 through 7-n, provided in a number corresponding to the number of screen partitions n.

Figure 10:
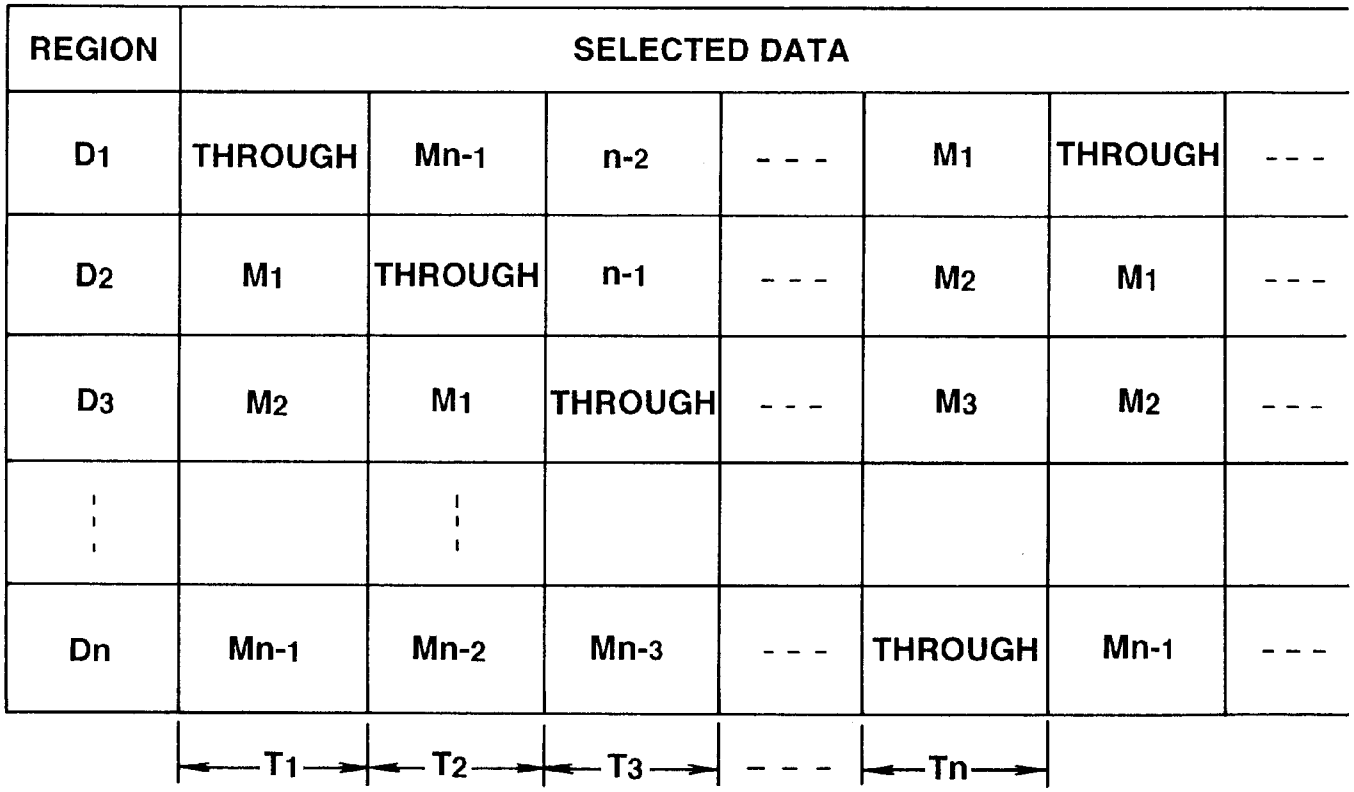
FIG. 10 is a diagram depicting a data switching operation by the bus selector in the embodiment of FIG. 8.

Specifics of selection switching by the bus selector 7 are presented in FIG. 10. The operation of the structure depicted in FIG. 8 will be described below referring to this drawing.

First, during the period T1 extending from the start of data read-out from the video memory 3 to the completion of output from the video memory 3 of all data corresponding to the screen partition D1, the switching circuit 7-1 selects the through data and outputs them sequentially to the most significant region D1 of the display 2; the other switching circuits 7-2 through 7-n select read data from memories M1 through Mn-1 and output them sequentially to the partition regions D2 through Dn of the display 2 (period T1 in FIG. 10). As a result, data from the video memory 3 for the screen partition D1 are output directly as through data to the most significant region D1 of the display 2, data for the previous cycle stored in regions 1/n~2/n of the frame memory M1 are output to region D2 of the display 2, data for the previous cycle stored in regions 2/n~3/n of the frame memory M2 are output to region D3 of the display 2, and so on until data for the previous cycle stored in regions (n−1)/n~n/n of the frame memory Mn are output to region Dn of the display 2. During period T1, data from the video memory 3 for the screen partition D1 are simultaneously written to the regions (0~1/n) of each memory M1 through Mn-1.

Next, during the period, T2, in which data corresponding to the screen partition D2 are output from the video memory 3, the switching circuit 7-2 selects the through data and outputs them sequentially to region D2 of the display 2, the other switching circuits 7-1 and 7-3 through 7-n select read data from memories Mn-1 and M1 through Mn-2 and output them sequentially to the partition regions D1 and D3 through Dn of the display 2. As a result, data from the video memory 3 corresponding to the screen partition D2 are output directly as through data to region D2 of the display 2, data previously written to regions (0~1/n) of the frame memory Mn-1 are output to region D1 of the display 2, data for the previous cycle stored in regions 2/n~3/n of the frame memory M1 are output to region D3 of the display 2, and so on until data for the previous cycle stored in regions (n−1)/n~n/n of the frame memory Mn-2 are output to region Dn of the display 2. During period T2, data from the video memory 3 for the screen partition D2 are simultaneously written to the regions (1/n~2/n) of each memory M1 through Mn-1.

Next, during the period, T3, in which data corresponding to the screen partition D3 are output from the video memory 3, the switching circuit 7-3 selects the through data and outputs them sequentially to region D3 of the display 2; the other switching circuits 7-1 and 7-2, and 7-4 through 7-n select read data from memories Mn-2, Mn-1, and M1 through Mn-3 and output them sequentially to the partition regions D1, D2, and D4 through Dn of the display 2. As a result, data from the video memory 3 corresponding to the screen partition D3 are output directly as through data to region D3 of the display 2, data previously written to regions (0~1/n) of the frame memory Mn-2 are output to region D1 of the display 2, data previously written to regions (1/n~2/n) of the frame memory Mn-1 are output to region D2 of the display 2, and so on until data for the previous cycle stored in regions (n−1)/n~n/n of the frame memory Mn-3 are output to region Dn of the display 2. During period T3, data from the video memory 3 for the screen partition D3 are simultaneously written to the regions (2/n~3/n) of each memory M1 through Mn-1.

This type of operation is executed repeatedly

Subsequently, during the period, Tn, in which data corresponding to the screen partition Dn are output from the video memory 3, the switching circuit 7-n selects the through data and outputs them sequentially to region Dn of the display 2; the other switching circuits 7-1 through 7-(n-1) select read data from memories M1 through Mn-1 and output them sequentially to the partition regions D1 through Dn-1 of the display 2. As a result, data from the video memory 3 corresponding to the screen partition Dn are output directly as through data to region Dn of the display 2, data previously written to regions (0~1/n) of the frame memory M1 are output to region D1 of the display 2, and so on until data for the previous cycle stored in regions (n -2)/n~(n- 1)/n of the frame memory Mn-1 are output to region Dn-1 of the display 2. During period Tn, data from the video memory 3 for the screen partition Dn are simultaneously written to the regions ((n−1)/n~n/n) of each memory M1 through Mn-1.

In the manner described above, the display operation involving output of data for one screen stored in the video memory 3 is completed. Subsequently, the same operation is executed repeatedly.

In the foregoing embodiment, dual port memories were used as the frame memory 4 or the memories M1 through Mn-1, but it would also be possible to use FIFO (first in first out memory) having a first in first out memory function.

In the embodiment depicted in FIG. 5, single words of the frame memory 4, the bit width of data output from the data conversion circuit 6, and the bit width of data for the upper screen UD and the lower screen DD were each 4 bits, but the number of bits is not restricted to this value as long as the number of bits is identical.

What is claimed is:

1. A display control device by which data stored in a video memory is displayed on the basis of a display control signals output from a CRT control device, the display control device comprising:

dual port memory means that allows data read and write operations to be executed simultaneously and that has a capacity to store at least one screen of first data to be displayed; and display control means for executing in parallel a first operation in which second data corresponding to an upper region of a display are retrieved from the first data stored in the video memory and sequentially output to said upper region of the display, a second operation in which the second data corresponding to the upper region of the display are sequentially stored in the dual port memory means and a third operation in which third data corresponding to a lower region of the display stored in the dual port memory means are sequentially output to said lower region of the display, for executing in parallel a fourth operation in which said third data corresponding to the lower region of the display are retrieved from the first data stored in the video memory and sequentially output to the lower region of the display, a fifth operation in which the third data corresponding to the lower region of the display are sequentially stored in the dual port memory means and a sixth operation in which fourth data corresponding to the upper region of the display stored in the dual port memory means are sequentially output to the upper region of the display and for alternately executing, in response to the display control signals, a first sequence comprised of the first to third operations and a second sequence comprised of the fourth to sixth operations.

2. The display control device of claim 1, wherein the dual port memory means has a write address clock terminal, a read address clock terminal, a write address reset terminal and a read address reset terminal and, when a write address and a read address are updated as incremented by one in synchronism with a predetermined clock signal commonly input to the both of the clock terminals and when a reset signal is input to the write address reset terminal and the read address reset terminal, the dual port memory means initializes the write address and the read address on a memory region corresponding to a first scanning line of the upper region of the display and wherein the device further comprises reset signal output means for outputting the reset signal to the write address reset terminal each time output of the data corresponding to the upper region of the display is started from the video memory and for outputting the reset signal to the read address reset terminal after the output of the second data corresponding to the upper region of the display is completed and before output of the third data corresponding to the lower region of the display is started from the video memory.

3. A display control device by which display data stored in a video memory is displayed on the basis of display control signals output from a CRT control device, wherein a display screen is partitioned into n partitions (n≧3) in a vertical direction, the display control device comprising:

(n−1) dual port memory means that allow data read and write operations to be executed simultaneously and that have a capacity to store at least one screen of data to be displayed on the display;

read/write control means for performing sequential common input of the data stored in the video memory to the (n−1) dual port memory means and for performing sequential cyclic read operations on the stored data using, as respective initial addresses, addresses each shifted to a degree equivalent to the address corresponding to data for (1/n) of the screen of the display from the (n−1) dual port memory means; and nth data selection means for alternately selecting, in a specified order, data read from the (n−1) dual port memory means and data retrieved from stored data in the video memory and for outputting in parallel the selected data to the respective partitioned regions of the display; and, wherein each of the dual port memory means has a write address clock terminal, a read address clock terminal, a write address reset terminal and a read address reset terminal, and when a write address and a read address are updated as incremented by one in synchronism with a specified clock signal commonly input to the both of the clock terminals and when a reset signal is input to the write address reset terminal and the read address reset terminal, the dual port memory means initializes the write address and the read address on a memory region corresponding to a first scanning line of an upper screen of the display and wherein the device further comprises reset signal output means for commonly outputting the reset signal to the write address reset terminal of the respective dual port memory means each time output of data corresponding to an upper region of the display is started from the video memory, for previously setting an order of outputting the reset signal to each read address reset terminal of the (n−1) dual port memory means and, for intermittently and switchingly outputting the reset signal to the read address reset terminal of the dual port memory means in accordance with the set order each time the output of the data corresponding to the (1/n) screen of the display screen is completed from the video memory.

* * * * *